US010124921B2

(12) United States Patent
Barron

(10) Patent No.: US 10,124,921 B2
(45) Date of Patent: Nov. 13, 2018

(54) FLUID DISPENSER FOR THE FOODSTUFF SUPPLY SECTOR

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/573,460

(22) PCT Filed: Apr. 19, 2016

(86) PCT No.: PCT/EP2016/058652
§ 371 (c)(1),
(2) Date: Nov. 11, 2017

(87) PCT Pub. No.: WO2016/184633
PCT Pub. Date: Nov. 24, 2016

(65) Prior Publication Data

US 2018/0134435 A1 May 17, 2018

(30) Foreign Application Priority Data

May 15, 2015 (DE) ..... 10 2015 208 966

(51) Int. Cl.
*B65B 69/00* (2006.01)
*B65D 83/00* (2006.01)

(52) U.S. Cl.
CPC ..... *B65B 69/005* (2013.01); *B65D 83/0055* (2013.01); *B65D 2231/001* (2013.01)

(58) Field of Classification Search
CPC ..... B65D 35/28; B65D 35/385; B65D 2231/001; B65D 83/0055; B65B 69/005
See application file for complete search history.

(56) References Cited

U.S. PATENT DOCUMENTS 1,352,425 A * 9/1920 Boye ..... B65D 35/28 222/101
1,924,195 A * 8/1933 Miles ..... B65D 35/28 222/101

(Continued)

OTHER PUBLICATIONS

International Search Report for Application No. PCT/EP2016/058652 dated Jul. 27, 2016 (English Translation, 2 pages).

*Primary Examiner* — Frederick C Nicolas
*Assistant Examiner* — Randall Gruby
(74) *Attorney, Agent, or Firm* — Michael Best & Friedrich LLP

(57) ABSTRACT

A fluid dispenser for the foodstuff supply sector has a dimensionally rigid housing (1) with viscous contents, wherein the fluid dispenser is designed to receive tubular bags which have a dispensing device (7) that is fitted or can be fitted on the tubular bag (2) itself and that permits metered dispensing of the contents. Moreover, the tubular bag (2) can be inserted and secured in a predetermined position in the fluid dispenser, and an auxiliary device is present with which the viscous contents located in the tubular bag can be continuously pushed in the direction of the dispensing device (7) on the tubular bag, by mechanical application of pressure to the tubular bag (2) in the position of use of the fluid dispenser. To secure the tubular bag (2) in the housing (1), a clamping device is present. The auxiliary device is a weighting roller (3) which is mounted between two lateral guides (5) in the housing (1) and which, in the position of use of the fluid dispenser, bears horizontally on the tubular bag (2) and, by means of its inherent weight, is able to push the viscous contents of the tubular bag continuously to the dispensing device (7) on the tubular bag. The auxiliary device additionally contains position-stabilizing means with which the horizontal bearing of the weight- (Continued)

ing roller on the tubular bag, in the position of use of the fluid dispenser, can be stabilized.

11 Claims, 5 Drawing Sheets

(56) References Cited

U.S. PATENT DOCUMENTS 2,064,357 A * 12/1936 Ritterbusch ..... B65D 35/285 222/102
2,065,016 A * 12/1936 Oldfield ..... B65D 35/34 222/100
2,168,080 A * 8/1939 Allen ..... B65D 35/28 222/101
2,206,985 A * 7/1940 Vogt ..... B67B 7/28 141/114
2,461,891 A * 2/1949 Giles ..... B65D 35/28 222/101
2,528,662 A * 11/1950 Miller ..... B65D 35/28 141/360
2,545,342 A * 3/1951 Choquette ..... B65D 35/28 222/101
2,570,755 A * 10/1951 Booth ..... B65D 35/28 141/362
2,643,795 A * 6/1953 Teal ..... B65D 35/28 222/101
2,837,243 A * 6/1958 La Zebnik ..... B65D 35/28 222/101
2,936,006 A * 5/1960 Henley ..... B65D 35/28 141/360
3,257,039 A 6/1966 Trutza
3,263,862 A * 8/1966 Tazzeo ..... B65D 35/28 222/101
3,384,271 A * 5/1968 Gronwald ..... B65D 35/28 222/101
3,417,902 A * 12/1968 Mirka ..... B65D 35/40 141/362
4,019,655 A * 4/1977 Moeller ..... A47K 5/08 222/101
5,199,610 A 4/1993 Gagliardi
5,490,613 A 2/1996 Taylor et al.
5,638,989 A 6/1997 Ophardt et al.
5,692,645 A * 12/1997 Ryu ..... A47K 5/122 222/101
5,868,282 A * 2/1999 Imhoff ..... B65D 35/28 222/101
6,196,420 B1 * 3/2001 Gutierrez ..... B67D 1/0001 222/101
6,968,977 B1 * 11/2005 Beene ..... B65D 35/28 222/101
2002/0092879 A1 7/2002 Chrisman et al.
2004/0206780 A1 * 10/2004 Sterner ..... B65B 69/0083 222/202

* cited by examiner

FLUID DISPENSER FOR THE FOODSTUFF SUPPLY SECTOR

BACKGROUND OF THE INVENTION

The invention relates to a fluid dispenser for the foodstuff supply sector.

The invention relates particularly to a fluid dispenser for the foodstuff supply sector having a dimensionally rigid housing for receiving a tubular bag with viscous contents, wherein the fluid dispenser is also designed to receive tubular bags which have a dispensing device that is fitted or can be fitted on the tubular bag itself and that permits metered dispensing of the contents. Moreover, the tubular bag can be inserted and secured in a predetermined position in the fluid dispenser, and an auxiliary device is present with which the viscous contents located in the tubular bag can be continuously pushed in the direction of the dispensing device on the tubular bag, by mechanical application of pressure to the tubular bag in the position of use of the fluid dispenser.

In the foodstuff supply sector, very large amounts of viscous products must today be delivered in so-called tubular bags for the purpose of maintaining hygienic conditions. These tubular bags are flexible containers on which a dispensing device, for example in the form of a metering pump, is integrated or at least attachable and which in the aggregate are provided for the onetime use. In this way, a contamination of the mostly perishable viscous products (e.g. sauces etc.) is to be prevented. Air is also to be prevented to the greatest possible extent from penetrating into the tubular bags during the emptying process, because penetrating air can promote the contamination and the oxygen in the air can also impair the quality of the products. Nevertheless, the tubular bags are, of course, to be emptied as completely as possible. Finally, there is even often a problem with solutions using disposable metering pumps because the uncontrolled crumpling of the tubular bags during the emptying process and the accompanying wrinkle formation in the tubular bags very often have the effect that a considerable portion of the tubular bag contents remains hanging in the creases and thus cannot be emptied. Estimates by a large distributor in the worldwide foodstuff supply sector assume that just an emptying capability of 96% instead of 88% could result in a yearly savings of the tubular bag contents in the amount of approximately 1 million $.

It is, of course, basically known that the effectively achievable emptying capability of a tubular bag is always dependent on different factors, for example: the emptying rate, the viscosity of the product and the type of tubular bag arrangement and deformation during the emptying process. Other factors, such as, for example, the manner of construction of the dispensing device or respectively the construction of the metering pump used can also play a role.

For the at least approximately complete emptying of tubular bags in the foodstuff sector, different devices and methods were already proposed and implemented before the appearance of metering pumps. These include, for example, simply letting the contents discharge by the natural influence of gravity, suction devices and squeezing devices, with which the tubular bag is, for example, squeezed under the effect of force between two fixed plates. Simply allowing the contents to discharge can, however, be unacceptable particularly with viscous products on account of the time required to do so; and even the suctioning as well as the squeezing each harbor the aforementioned risk that the complete emptying capability is impeded on account of the discharge routes being blocked by the creases which ensue from the wrinkle formation during the application of suction or force, which is for the most part uncontrollable.

An example of a device for dispensing mostly viscous products is described in the American U.S. Pat. No. 3,257,039A. Said U.S. Pat. No. 3,257,039A depicts a dispenser for the dispensing of tooth paste from compressible tubes, wherein the tubes are pressed out from the end of the tube between two serrated pressing rollers by means of a lever device that is to be operated manually. The tubes are not in the proper sense clamped but only held in a position between the pressing rollers and a recess at the dispensing end of the dispensers, and the tubes do not have dispensing devices fitted on the tube body itself. There is only a hingedly mounted closing cap, which is kept closed by means of a spring, on the housing of the dispenser. Because the lever device is slot guided, the lever device and therefore also the pressing rollers tilt slightly laterally. In principle, it is, however, a manually assisted gravity discharge solution.

The American U.S. Pat. No. 5,638,989A describes a dispenser for dispensing fluids from tubular bags. The tubular bags are held or respectively clamped in this case in a three point suspension, namely between two upper suspension hooks and a lower receiving opening for securing a dispensing device, wherein the dispensing device is in turn itself fitted to the tubular bag. The emptying process takes place under the influence of gravity; however, a pivotable clamp is also provided, which pushes against a side wall of the tubular bag in the central bag region and apparently at least in part improves the emptying capability of the tubular bag.

The American U.S. Pat. No. 5,490,613 describes a fluid dispenser for the foodstuff supply sector having a dimensionally rigid housing for receiving a tubular bag with viscous contents, wherein the fluid dispenser is additionally designed to receive tubular bags, which have a dispensing device, which is fitted itself to the tubular bag and can be operated manually, for the metered dispensing of the contents, and wherein the tubular bag can furthermore be inserted and secured in a predetermined position in the fluid dispenser and wherein an auxiliary device is provided, with which the viscous contents located in the tubular bag can be continuously pushed in the direction of the dispensing device on the tubular bag, by mechanical application of pressure to the tubular bag in the position of use of the fluid dispenser. The tubular bag is secured in the housing by means of a clamping using clamping means in the form of a three point clamping. The auxiliary device consists of at least one weighting roller which is mounted between two lateral guides in the housing and which, in the position of use of the fluid dispenser, bears on the tubular bag and, by means of its inherent weight, is able to push the viscous contents of the tubular bag continuously to the dispensing device on the tubular bag. In principle, this disclosure relates to a gravity discharge solution supported by weighting rollers. Because the two weighting rollers are only guided in guide slots, a lateral tilting of the weighting rollers is however possible.

Because none of these solutions is concerned with the increasingly occurring crease formation, which particularly occurs when pumping out tubular bags, then, for example, if the dispensing device, which is fitted to the tubular bag itself and permits metered dispensing of the contents, is itself a metering pump, even the conventional solutions having weighting rollers which utilize gravity and have lateral guides are not satisfactory. Because the crease formation is largely uncontrollable and random, these creases can occur on one side. If this is the case, the discharge support by means of the weighting rollers is likewise one-sided because said rollers can tilt and even under certain circumstances hang up on creases that have developed on one side. Contents which cannot be emptied often remain in the pockets of such creases. In such cases, the goal is only unsatisfactorily achieved, namely the aforementioned emptying of the tubular bag as completely as possible.

SUMMARY OF THE INVENTION

It is therefore the aim of the present invention to specify an improved solution for an emptying of tubular bags having a fluid dispenser, which is particularly suitable to the foodstuff supply sector, said emptying being as complete as possible. In particular, the intended solution is to be suitable for situations in which the tubular bags to be emptied tend to develop creases.

The solution includes that, in the case of a generic fluid dispenser having an auxiliary device with a passively operating weighting roller for supporting an emptying capability of the tubular bag that is as complete as possible, the auxiliary device is provided with position stabilizing means with which the horizontal bearing of the weighting roller on the tubular bag, in the position of use of the fluid dispenser, is stabilized. These position-stabilizing means have the effect that a tilting of the weighting roller can be largely prevented despite a possible one-sided crease formation. This measure can thus be virtually seen as a requirement for a 'complete roll out' of the tubular bag despite possible crease formation.

It should thereby be noted that the intended 'complete roll-out capability' of the tubular bag despite present creases also, of course, depends on whether the weighting roller can even overcome places with creases when moving downwards. To this end, the weighting roller needs a certain amount of resilience, which cannot however be too much because the roll-out capability then comes into question per se. It has been proven that a foam sheathing of the weighting roller with a certain sheathing foam layer thickness is particularly advantageous. Practice trials with standard tubular bags and metering pumps fitted thereon have shown that emptying rates of 96% to 98% can be achieved with this feature combination.

This and further advantages also ensue from the following detailed description of an exemplary embodiment for a fluid dispenser according to the invention.

DETAILED DESCRIPTION

Figure 1:
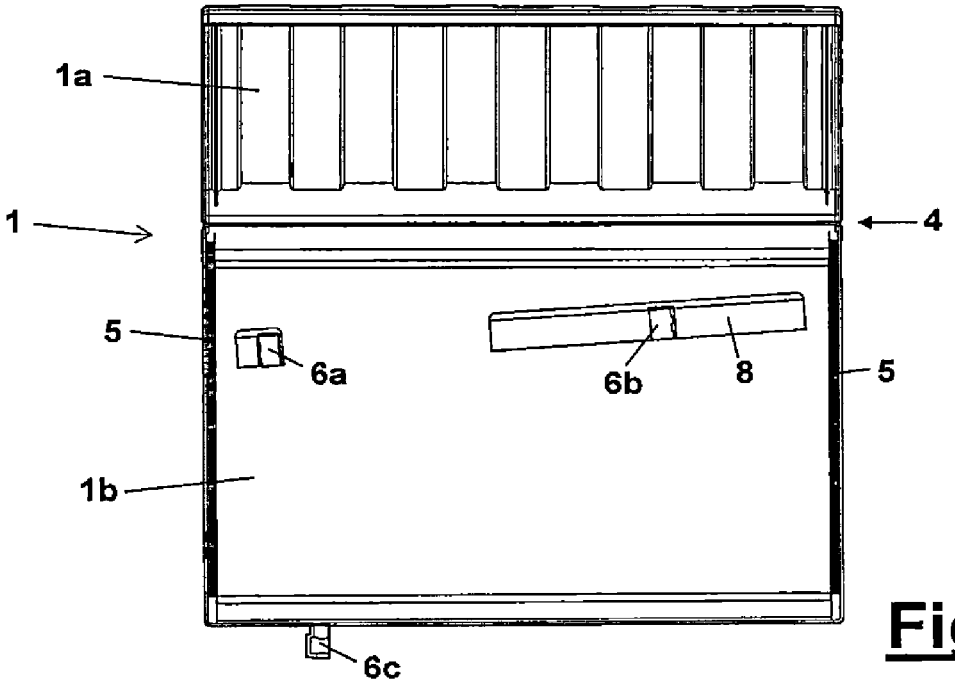
FIG. 1 shows the opened housing of a fluid dispenser without inserted tubular bag and without weighting roller in a view from on top.

FIG. 1 shows the opened housing 1 of a fluid dispenser without inserted tubular bag 2 and without weighting roller 3 (latter see FIGS. 2 and 3) in a view from above. The housing 1 consists of (opened) upper housing part 1*a* and a lower housing part 1*b*, which are connected in an articulated manner to one another via hinges (not depicted) in a hinged region 4 and which can be closed in a snapped shut position with a closing device, for example with a slider (not depicted) that deflects. The terms lower housing part and upper housing part refer here only to the depicted handling position which is suitable for fitting with a tubular bag. At least the upper housing part 1*a* is provided with a rib structure for stiffening.

At least one of the two housing parts 1*a*, 1*b*, in this case the lower housing part 1*b*, has on both sides guides which lie inward in edge regions, are designed as toothed racks and extend substantially over the entire width of the housing. The guides 5 are subcomponents of position-stabilizing means for the weighting roller 3. This will be explained in more detail below.

Clamping means 6*a*, 6*b*, which are designed as gripping means, are located in the lower housing part 1*b*. A lower clamping means 6*c* in the form of a fit-holder for a dispensing device 7 that is fitted or can be fitted on the tubular bag 2 itself and that permits metered dispensing of the contents is located in the lower housing part 1*b*. The upper clamping means 6*a*, 6*b* and the lower clamping means 6*c* are in their entirety denoted as clamping device and form the three point clamping for the tubular bag 2 that is mentioned above. The tubular bag 2 is held clamped in the housing 1 therefore by means of the three point clamping between the upper clamping means 6*a*, 6*b* and the lower clamping means 6*c*. In order to ensure as good a clamping as possible or respectively to minimize the development of creases during the entire emptying process of the tubular bag, additional spring tensioners (not depicted) can, for example, be provided for the upper clamping means 6*a*, 6*b*. In so doing, the dimension changes of the tubular bag can be taken into account during the emptying process.

It has already been mentioned that the dispensing device 7 is or can be fitted on the tubular bag 2 itself at least prior to use because the objective shall be that the tubular bag 2 including the dispensing device 7 used shall be designed for single use for hygienic reasons. The dispensing device 7 can therefore, for example, be a disposable metering pump 10 or e.g. also a disposable, push-up type closure or a disposable rotary closure. The housing 1 as well as the lower clamping means 6*c* are therefore designed such that they, depending on the type of the dispensing device used, can receive and fixedly position the same and in fact in such a way that at least parts of the dispensing device 7, such as a fluid outlet of the same, protrude out of the housing 1 when the tubular bag 2 is inserted and said housing is closed (cf. FIG. 2). In the present exemplary embodiment, the metering pump 10 protrudes out of the housing 1, which, of course, enables a metering pump drive to be used which can be separately coupled to the metering pump 10.

It can furthermore be seen from FIG. 1 that at least one of the upper clamping means 6*a*, 6*b*, here concretely the upper clamping means 6*b*, can be adjusted as to the distance to the other upper clamping means. To this end, the upper clamping means 6*b* is disposed on a clamping means guide 8 so as to be displaceable and lockable in position. Thus, a tubular bag itself can always be inserted in an optimally tensioned manner independently of the filling state of the same. In addition, the upper clamping means 6*b* is disposed offset with respect to the housing 1 and with respect to the other upper clamping means 6*a*, in order to achieve an oblique position of the inserted tubular bag 2 in the range of 4-6 angular degrees. The slightly oblique position makes it possible for standardized, i.e. simple to manufacture and substantially rectangular, tubular bags, in the position of use of the fluid dispenser, to always be clamped such that a discharge inclination develops at least in the base side region of the tubular bag, i.e. there where the dispensing device is fitted. By means of this discharge inclination, a practically complete discharge of the tubular bag contents in the direction of the dispensing device 7 is ensured even in the end phase of the emptying process. Because the device is designed for standardized tubular bags, which always have a certain flexibility and which additionally also have the shown corner arrangement of the dispensing device 7, such a slight oblique position is no problem even in the region of the dispensing device. This is further illustrated in FIGS. 2 and 7.

Figure 2:
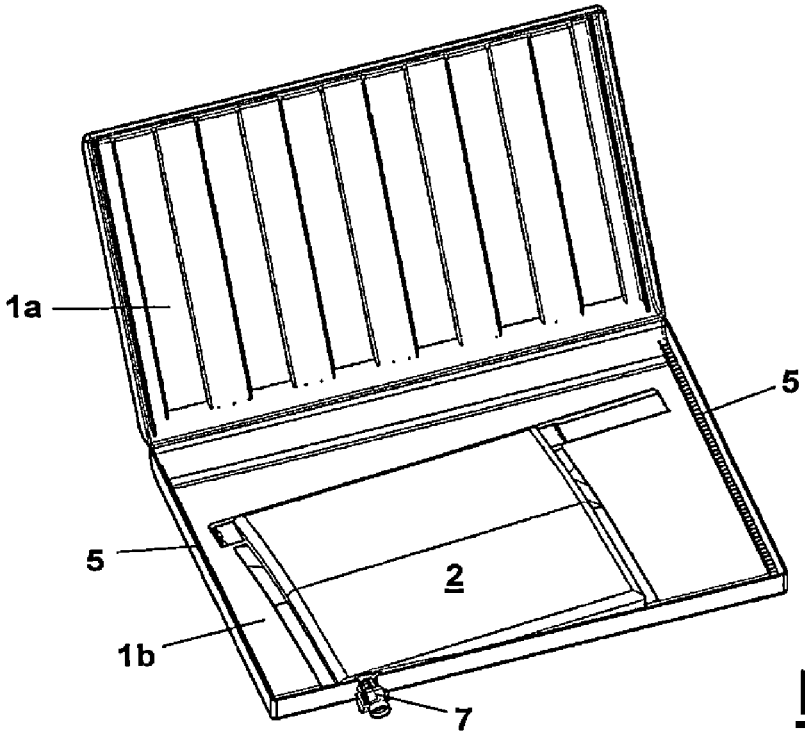
FIG. 2 shows the housing from FIG. 1 with inserted tubular bag in a spatial view.

FIG. 2 shows the housing of FIG. 1 with inserted tubular bag 2 in a spatial view. The previously mentioned oblique position of the tubular bag 2 in the inserted state can be readily seen here. The dispensing device 7 of the tubular bag 2 or at least parts thereof protrude out of the lower housing part.

Figure 3:
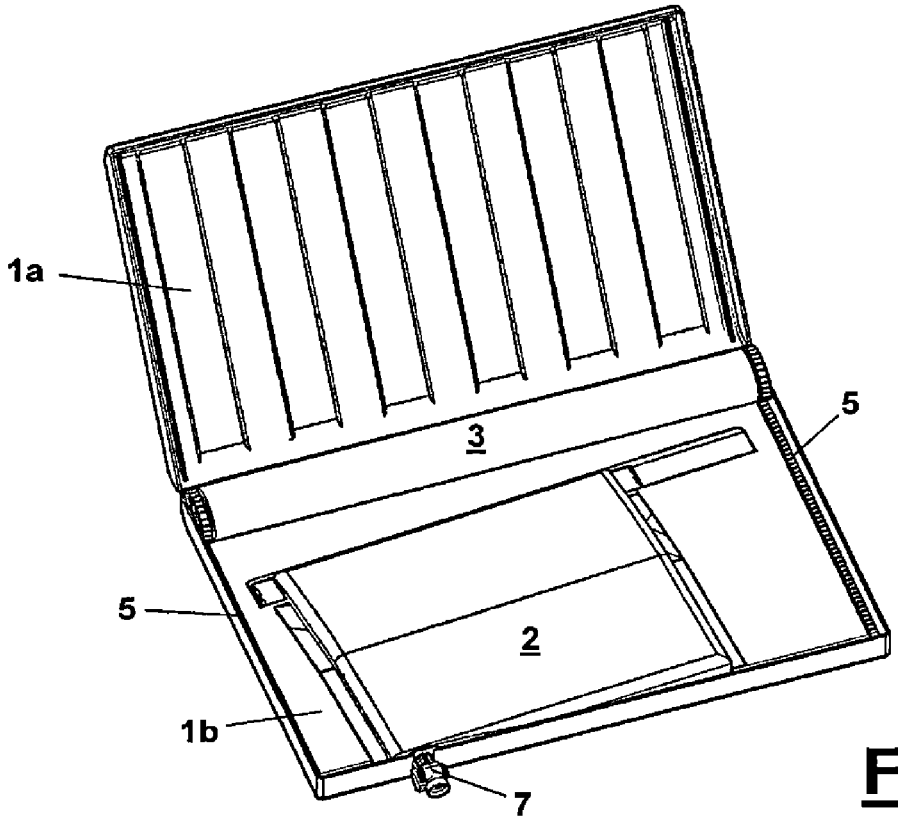
FIG. 3 shows the housing from FIG. 1 with inserted tubular bag and inserted weighting roller in a spatial view.

FIG. 3 shows the housing 1 from FIG. 1 with inserted tubular bag 2 and inserted weighting roller 3 in a spatial view. This depiction also clarifies in which position the weighting roller 3 is to be used when equipping the fluid dispenser with a full tubular bag 2.

Figure 4:
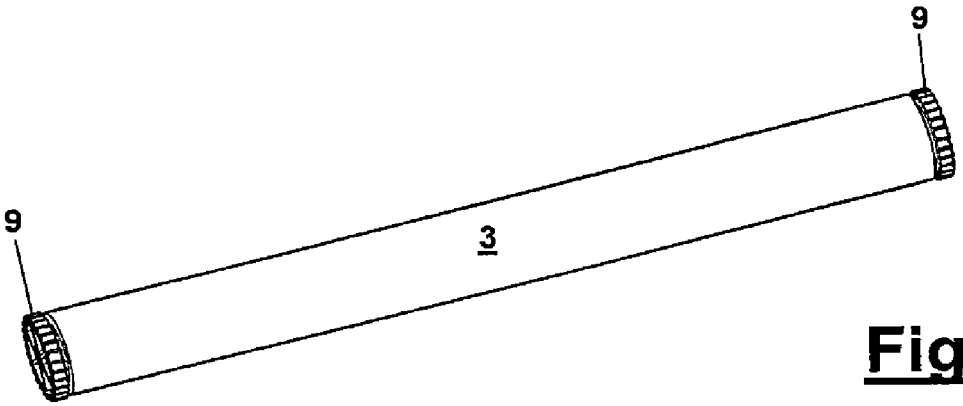
FIG. 4 shows the weighting roller in a spatial view.

FIG. 4 shows the weighting roller 3 in a spatial view. It can be clearly seen here that the weighting roller 3 has gear wheels 9 on both sides on the end faces. Said gear wheels can, of course, be integrally formed as one piece on a cylindrical core 10 of the weighting roller 3. The gear wheels 9 interact with the guides 5 in the housing 1 that are formed as toothed racks and in fact in such a way that the weighting roller 3 can be moved back and forth so as to be tooth rack guided on both sides in the closed housing 1. Because the gear wheels 9 cannot jump out of the toothed rack guides, a lateral tilting of the weighting roller 3 is effectively prevented. The gear wheels 9 and the toothed racks are thus position-stabilizing means for an auxiliary device, wherein the weighting roller, which by means of its inherent weight is able to push the contents situated in the tubular bag continuously in the direction of the dispensing device, can be seen as precisely this auxiliary device. When using a weighting roller for the specified purpose, there are in principle also other technical means for achieving a comparable position stabilization. Further references thereto follow immediately after the figure description of the present exemplary embodiment.

Figure 5:
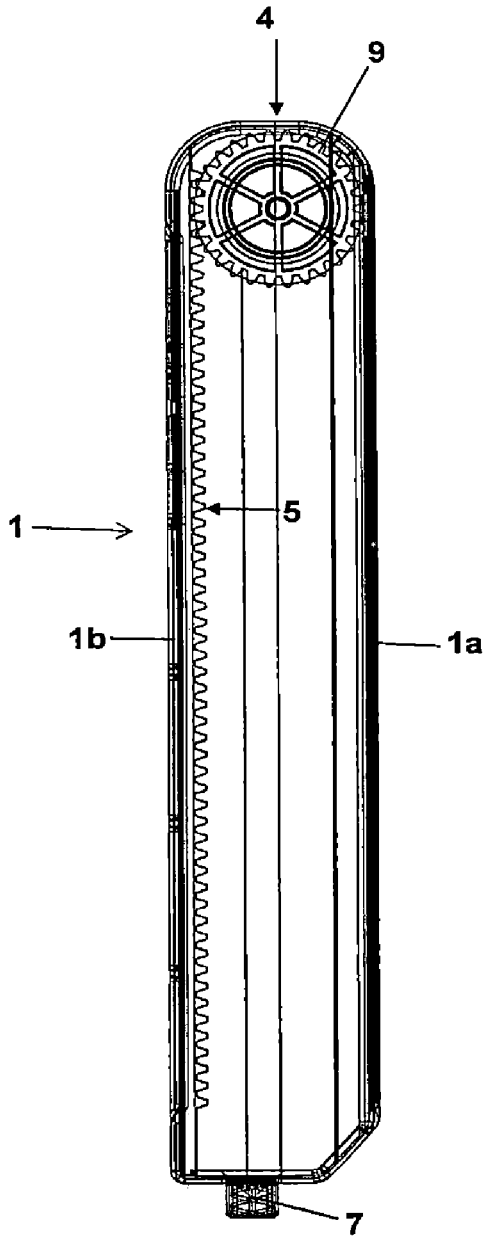
FIG. 5 shows a cross-sectional drawing of the closed housing from FIG. 1.

FIG. 5 shows a cross-sectional drawing of the closed housing 1 from FIG. 1, wherein the cross-section is set in the region of the gear wheel 9 and the guide 5 with the toothed rack. The housing 1 is depicted here in the position of use of the fluid dispenser, i.e. in the position in which the dispensing device 7 is at the lowest point of the device. It is made clear here that the weighting roller 3 could thus readily roll downwards to the dispensing device 7 in the absence of a tubular bag 2.

Figure 6:
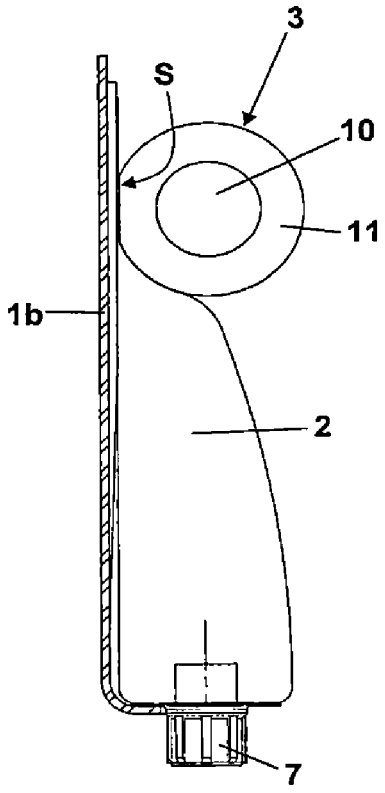
FIG. 6 shows a schematic partial section of the housing from FIG. 1 in order to explain the function.

FIG. 6 shows a schematic partial cross-section of the housing of FIG. 1 in order to explain the function. In contrast to the depiction according to FIG. 5, a tubular bag 2 is inserted here and is already approximately half-emptied. The weighting roller 3 lies on as well as laterally on the tubular bag 2 and thus pushes the contents of the tubular bag 2 continuously in the direction of the dispensing device 7. The lateral contact takes place in a bearing region S, which is, of course, displaced downwards with the continuing emptying of the tubular bag. Parts of the tubular bag 2 that have already been emptied are located above the weighting roller 3 and rest against the lower housing part 1*b*. The weighting roller 3 itself has a cylindrical, elongated and fixed core 10 and an elastic sheathing 11 that surrounds the core 10 like a cylinder jacket. The fixed core 10 is preferably made from a heavy material, for example metal. The elastic sheathing 11 is preferably from a soft foam. The layer thickness of the sheathing 11 is preferably in a range of 6 to 10 mm.

As is shown at least partially in FIG. 6, the soft sheathing 11 deforms by means of the weighting roller 3 bearing horizontally on the tubular bag 2. In the event that creases form in the lateral bearing region S on the tubular bag 2 as a result of pumping out the contents, the weighting roller 3 can overcome this as a result of the soft sheathing 11 and not be stopped thereby.

Figure 7:
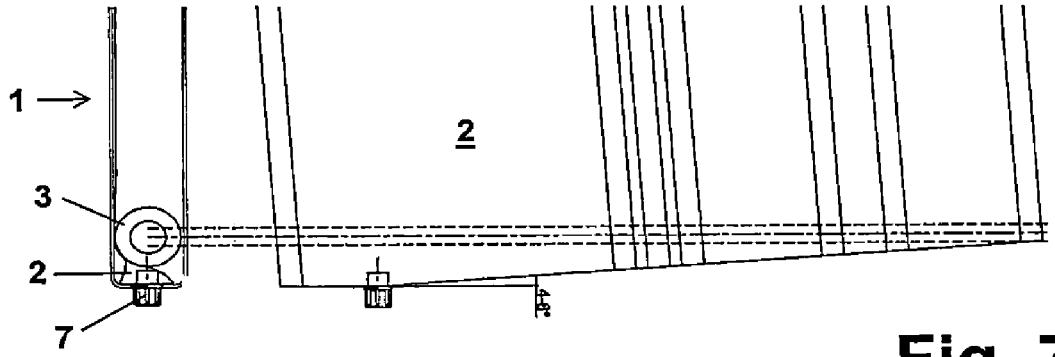
FIG. 7 shows a further schematic partial section of the housing from FIG. 1 to explain the residue emptying.
Figure 8:
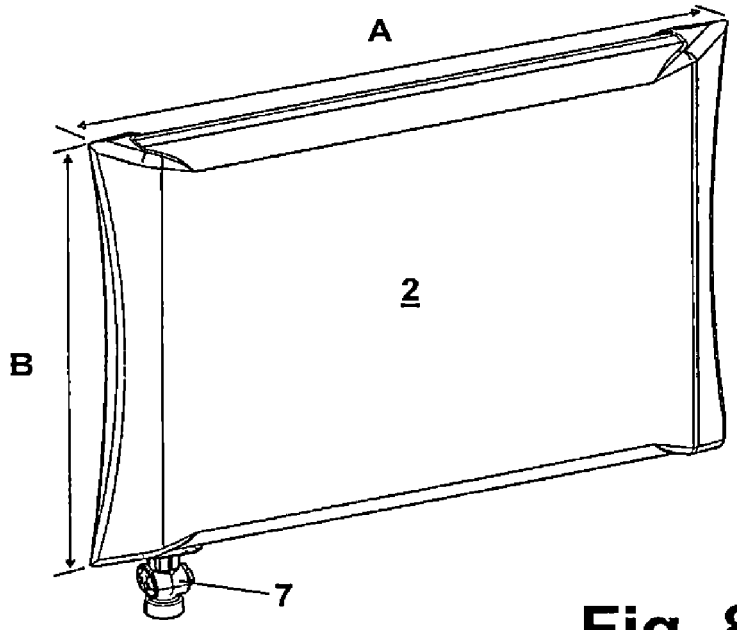
FIG. 8 shows a tubular bag with a metering pump fitted thereto in a spatial view.

FIG. 7 shows a further schematic partial cross-section of the housing 1 of FIG. 1 to explain the emptying of residues. It is obvious here that the weighting roller 3 has traveled to the lower end of the tubular bag 2 and cannot roll further downwards due to the slightly oblique position of the tubular bag 2. This depiction also makes it clear that the oblique position of the tubular bag must remain small during the application of the solution 2 according to the invention in order to achieve an emptying capability that is as good as possible. If the oblique position is made to small, residual amounts of the contents can no longer flow to the dispensing device 7. If the oblique position is however made too large, the weighting roller 3 can no longer support the pushing of the remaining residual amounts in this critical region precisely on account of the position-stabilization means. An oblique position of the tubular bag 2 in the range of 4 to 6 angular degrees has proven itself to be particularly advantageous.

In order to further clarify the device as a whole, a filled standardized tubular bag 2 comprising a dispensing device 7 that is fitted on said tubular bag and is in the form of a metering pump that is known per se is depicted as a whole in a spatial view. Such a tubular bag is substantially rectangular and has a length A and a width B. The volume of such tubular bags varies preferably in a range from approximately 1 to 12 liters. It goes without saying that a filled tubular bag will no longer be exactly rectangular, as suggestively depicted, but deforms similar to an hour glass. Trials have shown that the dimensional changes in width B and length A from the empty state with respect to the full state vary by approximately 4% respectively approximately 9%. This, of course, means that the tightness of the three point clamping of the tubular bag 2 between the clamping means 6*a*, 6*b*, 6*c* likewise changes during the course of the emptying process, which is, of course, a reason why additional means are necessary on the weighting roller 3 in order to overcome developing creases.

Figure 9:
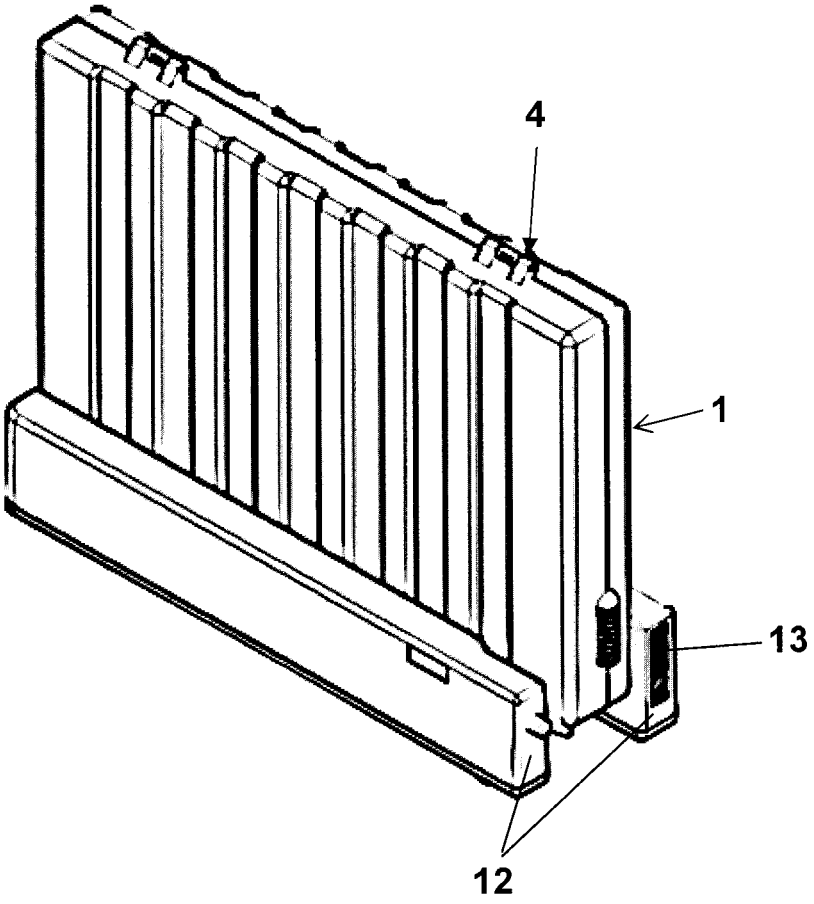
FIG. 9 shows a fluid dispenser with the housing of FIG. 1 placed thereon or respectively inserted therein.

FIG. 9 finally shows still another fluid dispenser with the housing of FIG. 1 that has been set on the base unit or respectively inserted therein. An outside view of the fluid dispenser in the position of use is shown. To this end, the housing 1 of the fluid dispenser can be inserted or set on a base unit 12, wherein said fluid dispenser is held in the position of use by the base unit 12, which means that the weighting roller 3 is able to push perpendicularly or at least approximately perpendicularly downwards on the tubular bag 2. The dispensing device 7 is not visible in this depiction; is however, represented in an implied manner by control elements 13 on the base unit 12 with which a drive for a one-way metering pump on the tubular bag can be controlled.

Coming back to the position-stabilization means for the position stabilization or respectively the prevention of a tipping of the weighting roller 3, it should be mentioned that there are also still other technical means for achieving this goal. Conical grooves can, for example, be applied to the guides 5, and guide wheels with a conical wheel edge formation can be fitted instead of toothed racks and gear wheels. Such constructions also can effectively prevent the weighting roller 3 from tilting because a mutual canting is practically impossible.

The invention claimed is:

1. A fluid dispenser for the foodstuff supply sector comprising a dimensionally rigid housing (1) configured to receive a tubular bag (2) with viscous contents, wherein the tubular bag has a dispensing device (7) that is fitted or can be fitted on the tubular bag (2) and permits metered dispensing of the contents, and wherein the tubular bag (2) can furthermore be inserted and secured in a position in the fluid dispenser, an auxiliary device with which the viscous contents located in the tubular bag can be continuously pushed in the direction of the dispensing device (7) on the tubular bag, by mechanical application of pressure to the tubular bag (2) in the position of use of the fluid dispenser, and a clamping device configured to secure the tubular bag (2) in the housing (1), wherein the auxiliary device is a weighting roller (3) which is mounted between two lateral guides (5) in the housing (1) and which, in a position of use of the fluid dispenser, bears horizontally on the tubular bag (2) and, by means of inherent weight of the roller, is able to push the viscous contents located in the tubular bag continuously to the dispensing device (7) on the tubular bag, characterized in that the auxiliary device contains position-stabilizing means with which the horizontal bearing of the weighting roller on the tubular bag, in the position of use of the fluid dispenser, can be stabilized; wherein the clamping device is configured to achieve a three point clamping for the tubular bag (2) having two upper clamping means (6*a*, 6*b*) in the position of use and one lower clamping means (6*c*) in the position of use, wherein the lower clamping means is a holder for the dispensing device (7) that is fitted or can be fitted on the tubular bag (2), characterized in that at least one of the upper clamping means (6*a*, 6*b*) is adjustable so as to vary the distance to the other upper clamping means (6*b*, 6*a*).

2. The fluid dispenser according to claim 1, characterized in that the position stabilization means include toothed racks in the guides (5) and gear wheels (9) that interact with the toothed racks on the end faces of the weighting roller (3).

3. The fluid dispenser according to claim 1, characterized in that the position stabilization means include conical grooves in the guides (5) and guide wheels with conical wheel edge formation, which interact with the conical grooves, on the end faces of the weighting roller (3).

4. The fluid dispenser according to claim 1, characterized in that the weighting roller (3) has an elongated cylindrical core (10) and an elastic sheathing (11) that surrounds the core (10) like a cylinder jacket.

5. The fluid dispenser according to claim 4, characterized in that the elastic sheathing (11) consists of a foam having a sheathing layer thickness of 6-10 mm.

6. The fluid dispenser according to claim 1, characterized in that the housing has two parts and is configured to be folded open.

7. The fluid dispenser according to claim 1, characterized in that the housing (1) is configured to be inserted in a base unit (12) or set on the base unit.

8. The fluid dispenser according to claim 1, characterized in that the upper clamping means (6*a*, 6*b*) in the position of use include gripping means.

9. The fluid dispenser according to claim 1, characterized in that the upper clamping means (6*a*, 6*b*) are obliquely offset with respect to the housing (1) in order to achieve an oblique position of the inserted tubular bag (2) in the range of 4-6 angular degrees.

10. The fluid dispenser according to claim 1, characterized in that the holder is configured for dispensing devices such as metering pumps, push-in or rotary closures.

11. The fluid dispenser according to claim 1, characterized in that the fluid dispenser is configured for receiving standardized, substantially rectangular tubular bags (2), which comprise a volume range of 1 liter to 12 liters.

* * * * *